US008418640B2

(12) United States Patent
Leverette

(10) Patent No.: US 8,418,640 B2
(45) **Date of Patent: *Apr. 16, 2013**

(54) SEMISUBMERSIBLE OFFSHORE PLATFORM WITH DRAG-INDUCING STABILIZER PLATES

(75) Inventor: Steven John Leverette, Richmond, TX (US)

(73) Assignee: Seahorse Equipment Corp, Houston, TX (US)

( * ) Notice: Subject to any disclaimer, the term of this patent is extended or adjusted under 35 U.S.C. 154(b) by 202 days.

This patent is subject to a terminal disclaimer.

(21) Appl. No.: 13/024,788

(22) Filed: Feb. 10, 2011

(65) Prior Publication Data

US 2011/0126750 A1 Jun. 2, 2011

Related U.S. Application Data

(63) Continuation-in-part of application No. 12/182,629, filed on Jul. 30, 2008, now Pat. No. 7,900,572.

(51) Int. Cl.
*B63B 35/44* (2006.01)

(52) U.S. Cl.
USPC ..... 114/264; 114/122; 114/267

(58) Field of Classification Search ..... 114/122, 114/264, 265, 266, 267; 405/223.1, 224, 405/224.2

See application file for complete search history.

(56) References Cited

U.S. PATENT DOCUMENTS

| | | | | |
|---|---|---|---|---|
| 3,986,471 | A | 10/1976 | Haselton | |
| 4,232,623 | A | 11/1980 | Chou et al. | |
| 5,038,702 | A | 8/1991 | Bowes | |
| 5,653,188 | A | 8/1997 | Molin | |
| 6,206,614 | B1 | 3/2001 | Blevins et al. | |
| 6,220,194 | B1 | 4/2001 | Kjersem | |
| 6,652,192 | B1 | 11/2003 | Xu et al. | |
| 6,978,728 | B2 | 12/2005 | Koop et al. | |
| 7,900,572 | B2 * | 3/2011 | Leverette | 114/264 |
| 2001/0026733 | A1 | 10/2001 | Ludwigson | |
| 2002/0139286 | A1 | 10/2002 | Lee et al. | |
| 2007/0221112 | A1 | 9/2007 | Haney et al. | |
| 2008/0115714 | A1 | 5/2008 | Tahar et al. | |
| 2009/0229505 | A1 | 9/2009 | Williams et al. | |

* cited by examiner

*Primary Examiner* — Lars A Olson

(74) *Attorney, Agent, or Firm* — Wong, Cabello, Lutsch, Rutherford & Brucculeri L.L.P.

(57) ABSTRACT

A floating vessel is equipped with perforated plates which exhibit both an added-mass effect and a damping effect. The addition of porosity to an added mass plate phase-shifts the added mass force so that it becomes at least partially a damping force which does not depend on large velocities to develop a large damping force. Preferred porosity is in the range of about 5% to about 15% of total plate area. A semi-submersible vessel may have damper plates fitted between its surface-piercing columns, within a support grid in the area between the pontoons and/or extending from the sides of its pontoons. A truss spar offshore platform may have damper plates installed within its truss structure intermediate its hull and ballast tank. Drill ships and similar vessels may be equipped with damper plates extending from the sides of their hulls to reduce both heave and roll.

30 Claims, 8 Drawing Sheets

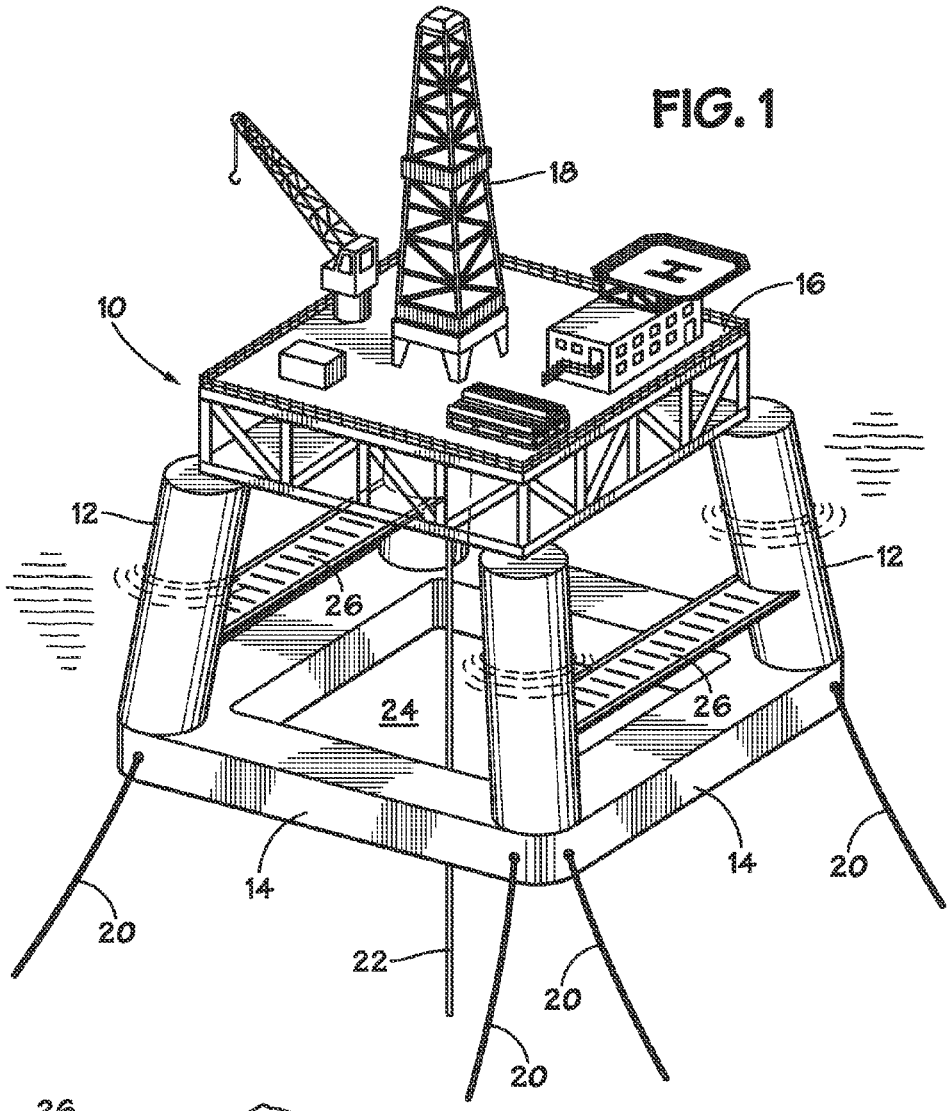
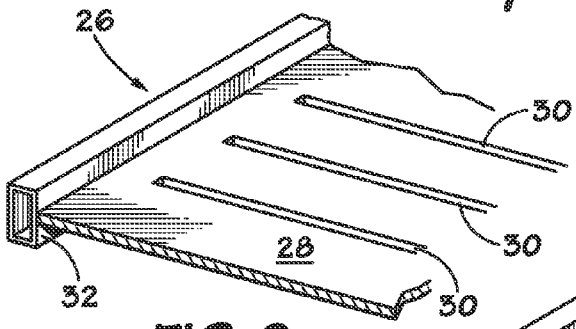
FIG. 2
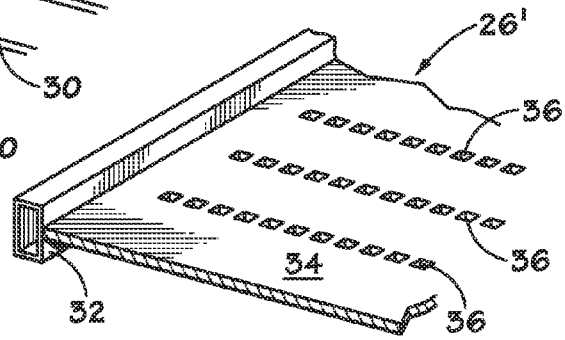

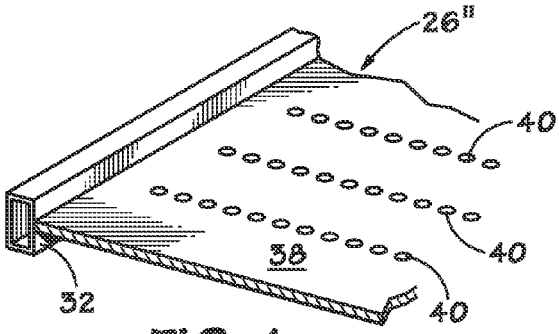
FIG. 4
FIG. 5A
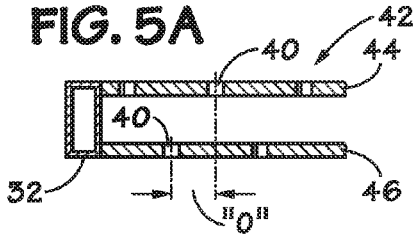
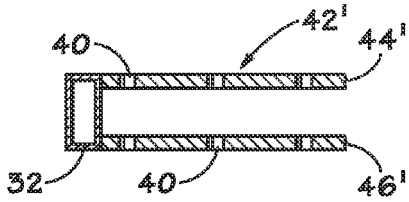
FIG. 5B
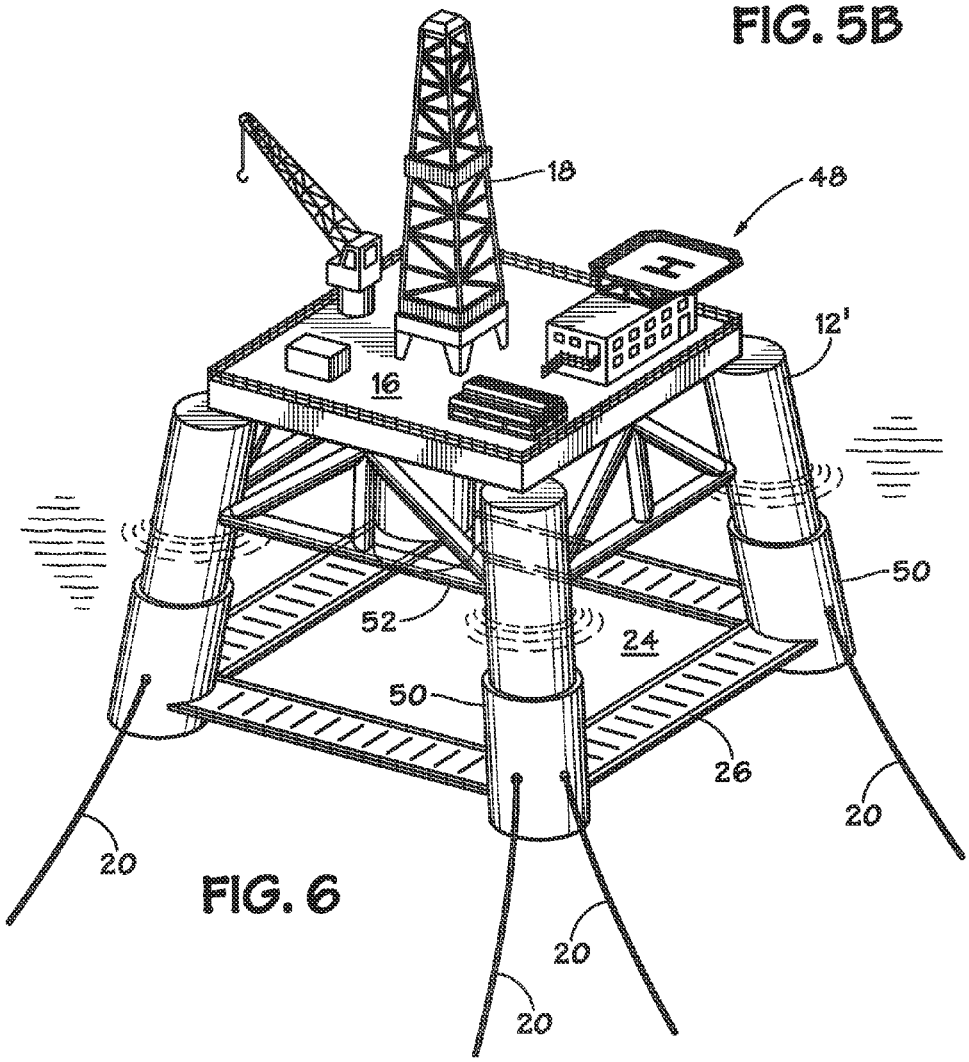
FIG. 6

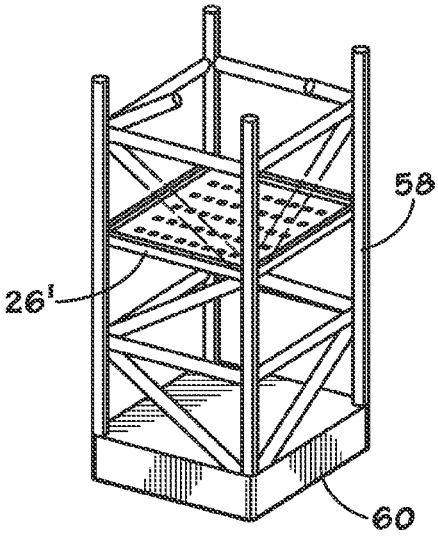
FIG. 9
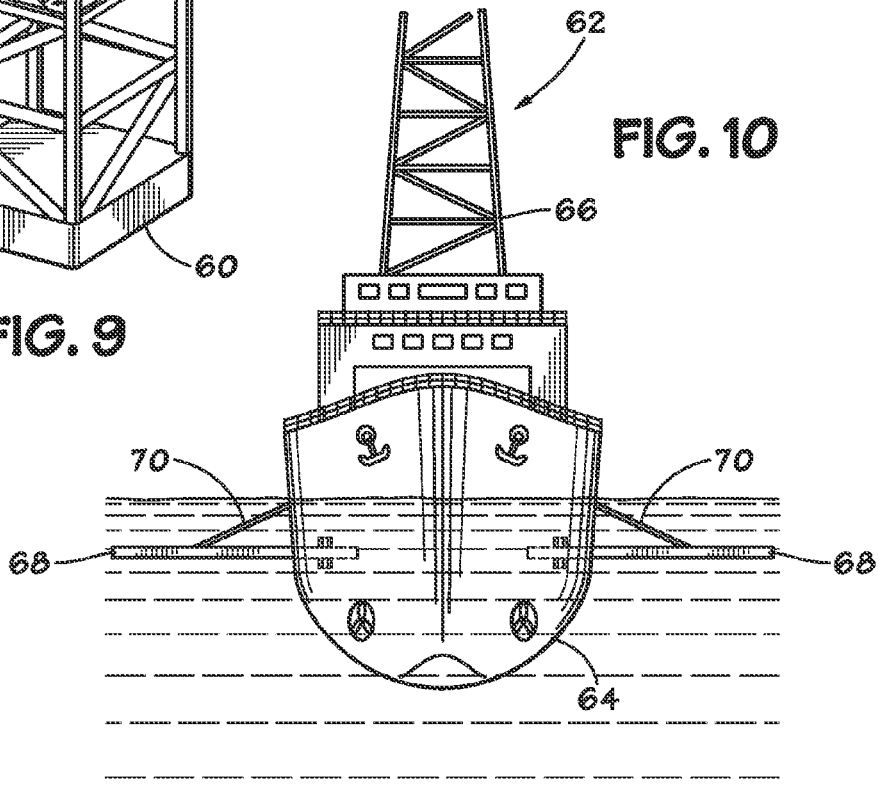
FIG. 10
FIG. 11
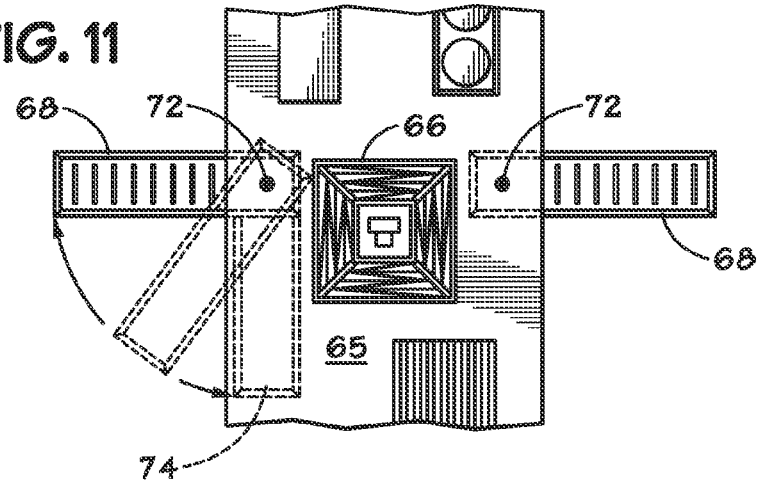

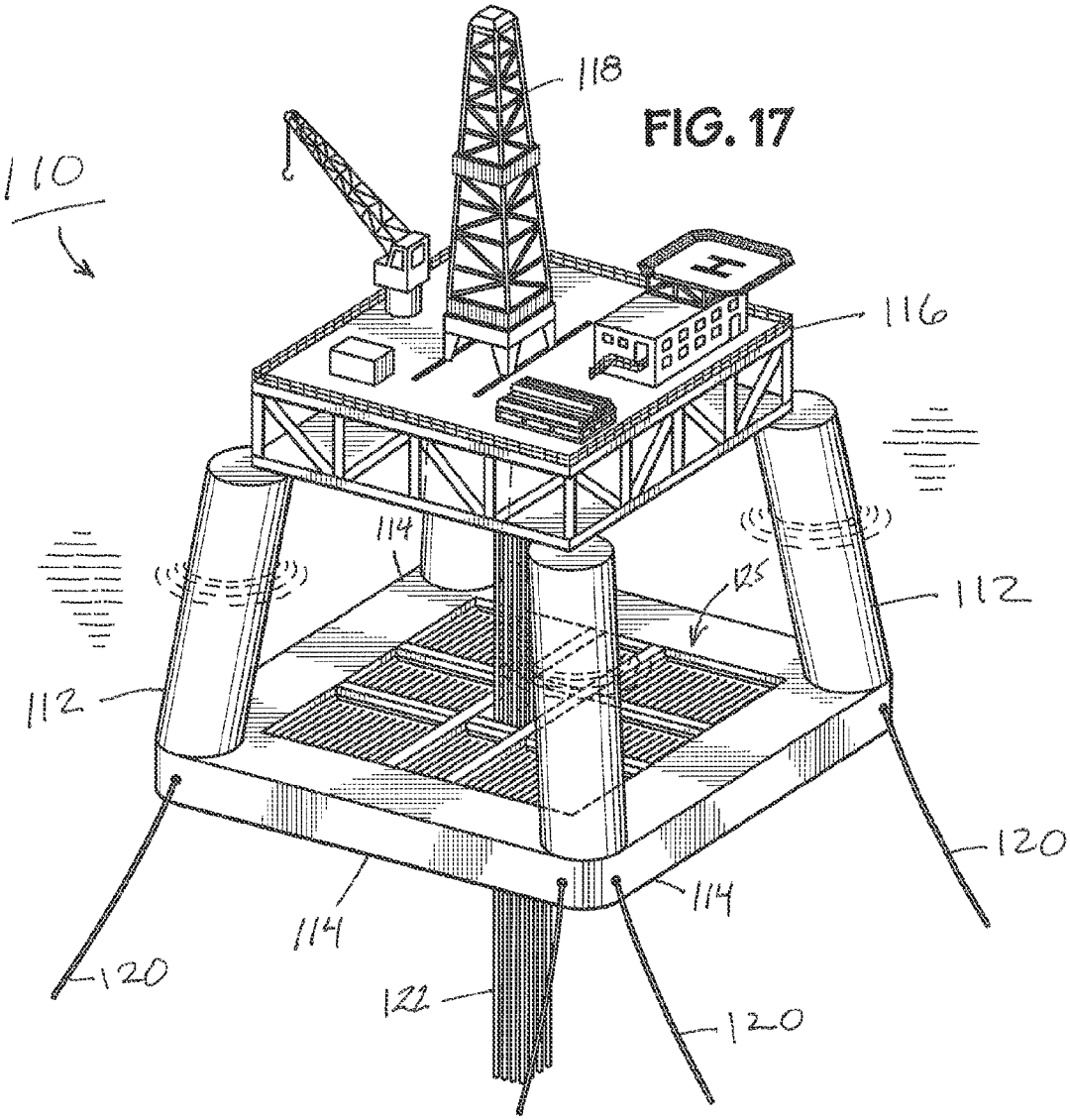
FIG. 17
FIG. 18
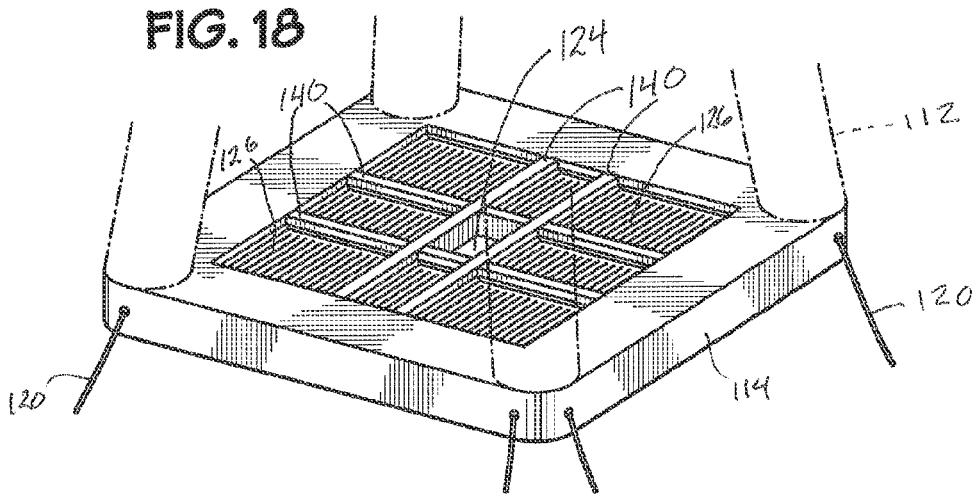

FIG. 19
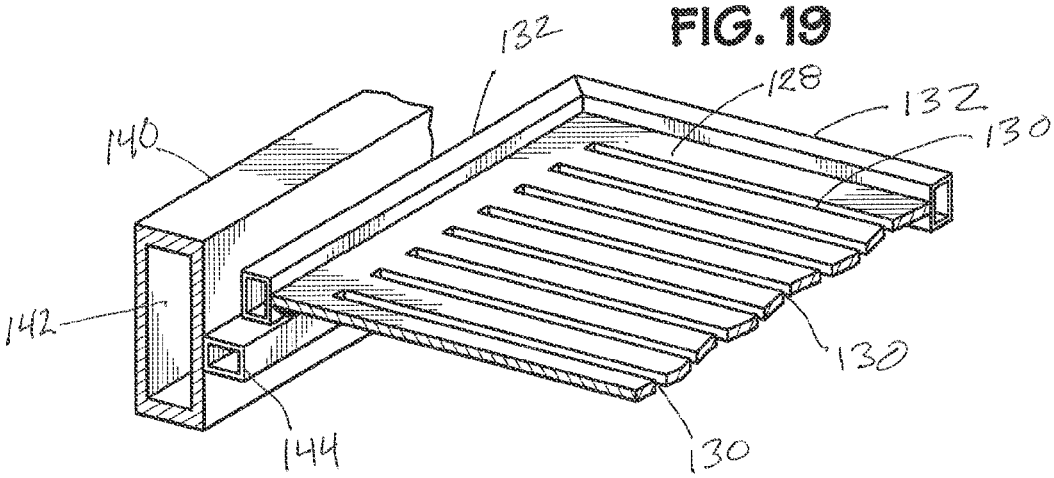
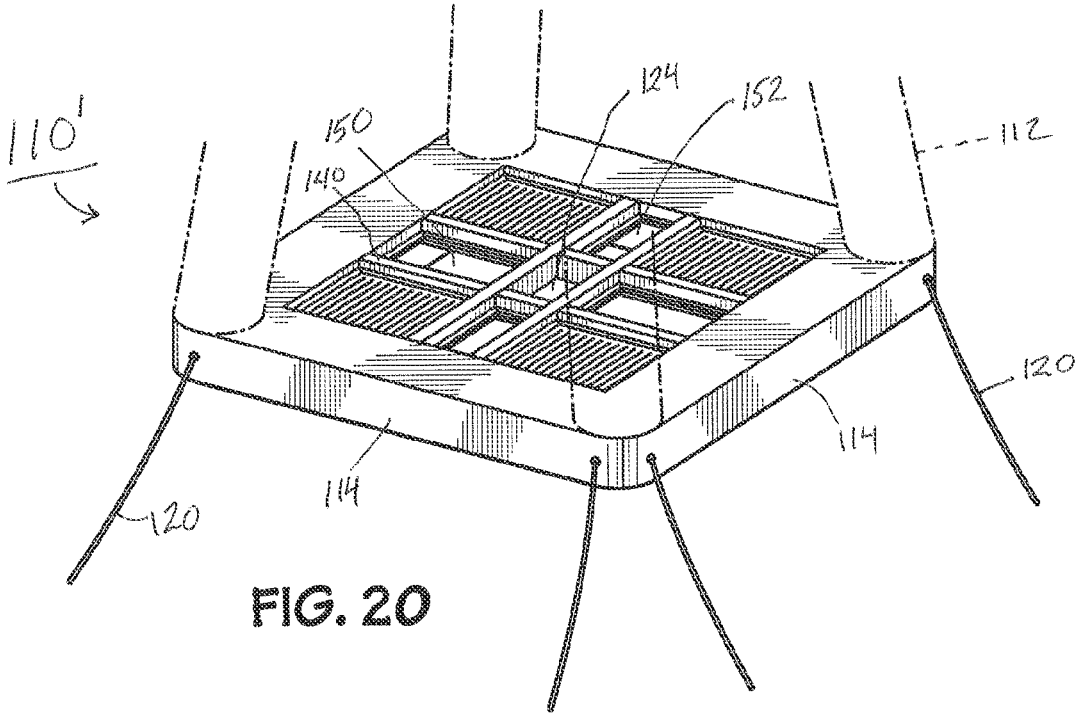
FIG. 20

SEMISUBMERSIBLE OFFSHORE PLATFORM WITH DRAG-INDUCING STABILIZER PLATES

CROSS-REFERENCE TO RELATED APPLICATIONS

This application is a continuation-in-part of U.S. patent application Ser. No. 12/182,629 filed Jul. 30, 2008, and entitled "Drag-Inducing Stabilizer Plates With Damping Apertures" the disclosure of which is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

This invention relates to offshore platforms and vessels. More particularly, it relates to floating structures which employ porous, added-mass stabilizer plates for motion suppression.

2. Description of the Related Art Including Information Disclosed Under 37 CFR 1.97 and 1.98

U.S. Pat. No. 3,986,471 describes an apparatus for damping vertical movement of a semi-submersible vessel having submerged pontoons and a small waterplane area which comprises a submerged damper plate equipped with valves for providing substantially greater resistance to upward movement of the plate than downward movement. The damper plate is supported deep beneath the semi-submersible vessel by flexible, tensioned supports such as chains or cables, at a depth beneath the water surface in the semi-submerged condition of the vessel where the amplitude of subsurface wave motion is less than the maximum heave amplitude which would be experienced by the semi-submersible vessel alone under identical sea conditions. The area of the damper plate is several times larger than the waterplane area of the vessel. An upward only-damping action is achieved due to the entrainment of large apparent masses of relatively still water by the damper plate.

U.S. Pat. No. 5,038,702 describes a semi-submersible platform supported on columns with pontoons extending between and outboard of the columns. Damper plates are provided by flat surfaces either on top of the outboard section of the pontoons or by plates positioned on the columns above the pontoons to provide heave and pitch stabilization and motion phase control in relation to the wave action such that when the platform is in the drilling mode, the heave phase of the platform is approximately 180° out of phase with wave action, and in the survival mode, heave action of the platform is substantially in phase with wave action.

U.S. Pat. No. 6,652,192 describes a heave-suppressed, floating offshore drilling and production platform that comprises vertical columns, lateral trusses connecting adjacent columns, a deep-submerged horizontal plate supported from the bottom of the columns by vertical truss legs, and a topside deck supported by the columns. The lateral trusses connect adjacent columns near their lower end to enhance the structural integrity of the platform. During the launch of the platform and towing in relatively shallow water, the truss legs are stowed in shafts within each column, and the plate is carried just below the lower ends of the columns. After the platform has been floated to the deep water drilling and production site, the truss legs are lowered from the column shafts to lower the plate to a deep draft for reducing the effect of wave forces and to provide heave and vertical motion resistance to the platform. Water in the column shafts is then removed for buoyantly lifting the platform so that the deck is at the desired elevation above the water surface.

U.S. Patent Publication No. 2002/0139286 describes a heave-damped floating structure that includes an elongate caisson hull and a plate set coupled to the hull. The plate set includes multiple heave plates located about an outer edge of the hull so as to form a discontinuous pattern generally symmetric about a vertical axis of the hull.

BRIEF SUMMARY OF THE INVENTION

The addition of porosity to an added mass plate phase-shifts the added mass force so that it becomes at least partially a damping force. This effect can develop fairly large damping forces without the need for the large relative velocities that drag damping forces typically require. A semisubmersible vessel according to the invention can be configured with porous damper plates that present a low profile to current forces thereby reducing station-keeping forces in high currents.

BRIEF DESCRIPTION OF THE SEVERAL VIEWS OF THE DRAWING(S)

FIG. 1 is a perspective view of a battered column, semi-submersible drilling rig equipped with added-mass stabilizer plates according to a first embodiment of the invention.

FIG. 2 is a perspective view of a stabilizer plate having slot-type damping apertures.

FIG. 3 is a perspective view of a stabilizer plate having generally square damping apertures.

FIG. 4 is a perspective view of a stabilizer plate having round hole-type damping apertures.

FIGS. 5A and 5B are cross-sectional views of alternative embodiments having paired stabilizer plates.

FIG. 6 is a perspective view showing stabilizer plates according to the invention mounted between the columns of a battered-column semi-submersible drilling rig without pontoons.

FIG. 9 is a perspective view of the truss portion of the spar shown in FIG. 7 equipped with a stabilizer plate having square damping apertures.

FIG. 10 is a front view (partially in cross section) of a drilling ship equipped with retractable roll stabilizers having damping apertures.

FIG. 11 is a top view of the drill ship shown in FIG. 10.

FIG. 17 is a perspective view of a semisubmersible offshore platform having a plurality of stabilizer plates situated between its pontoons.

FIG. 18 is a perspective view of the pontoons, support structure and stabilizer plates of the platform shown in FIG. 17.

FIG. 19 is a perspective view showing an attachment detail of a stabilizer plate to a support beam for the platform shown in FIG. 17.

FIG. 20 is a perspective view of an alternative arrangement of stabilizer plates between the pontoons of an offshore platform of the type illustrated in FIG. 17.

DETAILED DESCRIPTION OF THE INVENTION

Figure 7:
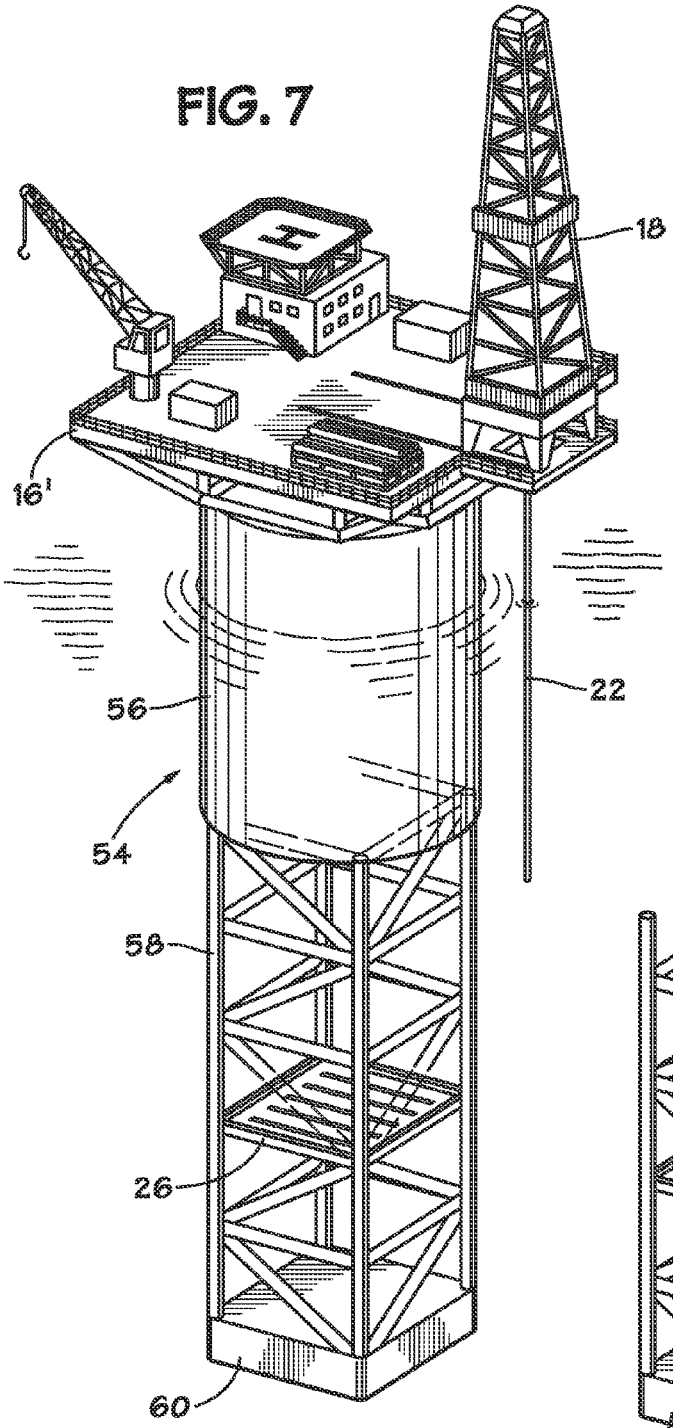
FIG. 7 is a perspective view of a truss spar drilling rig equipped with a stabilizer plate having slot-type damping apertures.

Floating offshore oil platforms and drilling ships need to limit their motions as much as possible in order to conduct uninterrupted drilling and production operations. However, these vessels are subject to motion, particularly in the vertical direction (heave), due to the action of waves and swells passing the vessel's location. Accordingly, such vessels are often designed to have minimal waterplane area so that the vessel's buoyancy is affected as little as possible by wave action.

Increasing the added mass is a technique that has been used for some time to improve the motion characteristics of floating offshore platforms. The more massive an object is, the more resistant it is to motion in reaction to an applied force (e.g., a passing wave). Semi-submersible drilling rigs are often very large and heavy to take advantage of this effect. Whenever a floating object moves in a body of water, some of the water must move with the vessel. This "attached" water also has mass and thus "adds" to the apparent mass of the vessel. Certain structures may be designed to maximize this effect. For example, heave plates may be added to offshore platforms and other vessels to increase their effective mass and thereby increase their resistance to acceleration in the vertical direction. Heave plates are typically flat plates fixed in a horizontal position such that moving the plate in a vertical direction presents a large surface area to the surrounding water. This requires a relatively large mass of water to move with the heave plate thereby adding to the apparent mass (and motion stability) of the vessel.

Additionally, the heave plate provides increased drag in the vertical direction. Drag is a retarding force exerted on a body as it moves through a fluid medium such as water. It is generally comprised of both viscous and pressure effects. One characteristic of drag forces is that the force is proportional to the square of the velocity and thus large drag forces result from large relative velocities.

Damping is a resistive force to velocity. In a system in an oscillating condition (such as motion in waves), damping is any effect, either deliberately engendered or inherent to a system, that tends to reduce the amplitude of oscillations of the oscillatory system. Floating vessels exhibit a heave natural period (oscillation) when displaced vertically. To avoid potentially damaging resonance, it is desirable to design a floating vessel such that its heave period is outside the range of wave periods likely to be encountered. Dampers act to suppress oscillation and generally provide an opposing force that varies in proportion to the system's displacement from its neutral position or state and the velocity of the displacement.

Perforated heave plates exhibit another damping effect in addition to that associated with heave plates of the prior art. The addition of porosity to an added mass plate creates a phase shift in the added mass force so that the water pressure normally associated with added mass forces acts as a damping force. The porosity allows the water to lag behind the structure—i.e., it continues to flow through the plate after the plate stops and reverses direction in oscillatory motion. This is very significant in that the effect allows the development of large damping forces without the need for the large displacements and velocities that would be necessary to develop large damping by drag forces.

The invention may best be understood by reference to certain illustrative embodiments shown in the drawing figures.

A battered-column, semi-submersible drilling rig 10 according to a first embodiment of the invention is shown in FIG. 1. Deck 16 (upon which drilling equipment 18 is mounted) is supported on battered columns 12 projecting above the waterline. Buoyancy is provided by columns 12 and pontoons 14 which connect columns 12 and form the perimeter of central opening 24 through which drill string 22 may pass. The invention may also be practiced with conventional semi-submersible rigs—i.e., those having vertical columns. When drilling operations are being conducted, rig 10 is held in position by catenary anchor lines 20 which connect to anchors on the seafloor. The invention may also be practiced with dynamically positioned drilling rigs—floating platforms which maintain their position using vectored thrust rather than anchors.

Plate-type heave dampers 26 extend between columns 12 below the waterline and above pontoons 14. Semi-submersible 10 shown in FIG. 1 comprises a pair of dampers 26. Other embodiments may have additional damper plates. Those skilled in the art will appreciate that it is desirable to locate the damper plates symmetrically about the center of the vessel.

In other embodiments of the invention (not shown), heave dampers 26 may be mounted to the vertical sides of pontoons 14. Dampers 26 may be mounted on the interior surface (i.e., within central opening 26), exterior surface or both. Dampers 26 in this configuration may be cantilevered or braced as dictated by structural considerations.

FIG. 2 shows damper plate 26 in greater detail. Damper 26 comprises slotted plate 28 connected to support member 32. Slots 30 provide openings through which water may flow from the upper surface of plate 28 to the lower surface of plate 28 and vice versa. Damper 26 may be constructed of any suitable material or combination of materials. One particularly preferred material is steel which provides relatively high strength at relatively low cost and may be worked using readily-available tools and equipment.

As shown in the exemplary embodiments of the drawing figures, support member 32 is a box beam. Other structures including, but not limited to, tubular members and flanged or un-flanged beams may similarly be used. Support members having a watertight internal cavity may also function as buoyancy members. It will be appreciated that damper plates according to the invention may be configured to present a relatively small frontal area to lateral movement of the vessel thereby minimizing the effects of currents and the station keeping forces necessary to hold the vessel in position. Low frontal area also is advantageous in reducing drag when the vessel is being moved from one location to another.

FIG. 3 shows one alternative damper plate 26' in detail. Damper 26' comprises perforated plate 34 connected to support member 32. Square apertures 30 provide openings through which water may flow from the upper surface of plate 34 to the lower surface of plate 34 and vice versa. Damper 26' may be constructed of any suitable material or combination of materials. One particularly preferred material is steel which provides relatively high strength at relatively low cost.

FIG. 4 shows yet another version of damper plate 26" in detail. Damper plate 26" comprises perforated plate 38 connected to support member 32. Round apertures or holes 40 provide openings through which water may flow from the upper surface of plate 38 to the lower surface of plate 38 and vice versa. Damper plate 26" may be constructed of any suitable material or combination of materials. One particularly preferred material is steel which provides relatively high strength at relatively low cost.

FIG. 5A is a cross-sectional view of a fourth embodiment of a damper according to the invention. Paired-plate damper 42 comprises upper plate 44 and lower plate 46 both of which are connected to support member 32. As shown in FIG. 5A, holes 40 in upper plate 44 may be axially offset distance "O" from corresponding holes 40 in lower plate 46. Alternatively, as illustrated in FIG. 5B, holes 40 in upper plate 44' of damper 42' may be axially aligned with corresponding holes 40 in lower plate 46'. By selecting the extent (if any) of the offset "O," the resistance to the flow of water from the upper surface of damper 42 to the lower surface of damper 42 (or vice versa) which may occur upon vertical movement of damper 42 may be modified, which may influence the damping effect.

A battered-column, semi-submersible drilling rig 48 according to another embodiment of the invention is shown in FIG. 6. Deck 16 (upon which drilling equipment 18 is mounted) is supported on battered columns 12 projecting above the waterline. Unlike the embodiment illustrated in FIG. 1, buoyancy is provided solely by columns 12 and there are no pontoons which connect columns 12. Rather, columns 12' are connected by truss structure 52. Columns 12' may have undersea section 50 of greater diameter to provide the buoyancy needed to support deck 16 without increasing the waterplane area of columns 12'. Perforated heave dampers 26 connect adjacent pairs of battered columns 12 and form the perimeter of central opening 24 through which drill string 22 may pass. The invention according to the embodiment of FIG. 6 may also be practiced with semi-submersible rigs having vertical columns. When drilling operations are being conducted, rig 48 is held in position by catenary anchor lines 20 which connect to anchors on or embedded in the seafloor. Alternatively, rig 48 may be dynamically positioned.

A truss spar platform according to the present invention is shown in FIG. 7. Truss spar platform 54 comprises generally cylindrical hull 56, truss structure 58 and ballast tank 60, as shown. Deck 16' is mounted to the top of hull 56. Drilling equipment 18 may extend over the side of deck 16' so that drill string 22 may be run to the seafloor. Alternatively, a moon pool may be provided in hull 56 for the drill string with corresponding openings in the damper and ballast tank. Ballast tank 60 (which may contain solid ballast) is sized and positioned so as to position the center of gravity of the vessel is below its center of buoyancy thereby ensuring its free-floating stability. The rig may be anchored in position by conventional catenary anchor lines (not shown).

Figure 8:
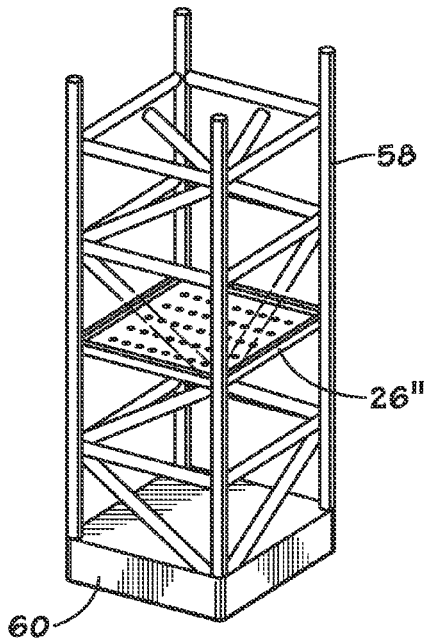
FIG. 8 is a perspective view of the truss portion of the spar shown in FIG. 7 equipped with a stabilizer plate having hole-type damping apertures.

At one or more points within truss structure 58 intermediate the bottom of hull 56 and the top of ballast tank 60 is heave plate 26. In the embodiment shown in FIG. 7, heave plate 26 comprises a slotted plate. FIG. 8 shows an alternative embodiment wherein heave plate 26" comprises a perforated plate with holes. FIG. 9 shows yet another embodiment of truss structure 58 wherein heave plate 26' comprises a plate having substantially square apertures.

Another embodiment of the invention is shown in FIG. 10. In this embodiment, ship-shaped offshore vessel 62 comprising hull 64, deck 65 and derrick 66 is equipped with retractable motion dampers 68 which may be extended from the sides of hull 64 below the waterline of the vessel. Motion dampers 68 may be retracted when the vessel is underway to reduce the drag acting on hull 64 or to permit the vessel to come alongside a dock or another vessel, such as a supply ship. Motion dampers 68, when extended, act to reduce both roll and heave of the vessel. Depending on their position relative to the center of the vessel, dampers 68 may also act to reduce pitching motions of the vessel.

FIG. 11 is a top view of a portion of the drill ship 62 shown in FIG. 10. Motion dampers 68 may swing into retracted position 74 (shown in phantom) by pivoting about pivots 72. As shown in FIG. 10, braces 70 may be attached between hull 64 and motion damper 68 to increase the structural rigidity of the extended dampers.

The motion dampers 68 shown in FIG. 11 are of the slotted plate type. It will be understood that plates having other aperture shapes (such as those illustrated in FIGS. 15 and 16) may also be used in the practice of the invention.

Another embodiment of the invention is shown in FIG. 10. In this embodiment, drill ship 62' comprising hull 64, deck 65 and derrick 66 is equipped with folding motion dampers 76 which may be extended from the sides of hull 64 below the waterline of the vessel. Motion dampers 76 may be retracted when the vessel is underway to reduce the drag acting on hull 64 or to permit the vessel to come alongside a dock or another vessel, such as a supply ship. Hinged motion dampers 76, when extended, act to reduce both roll and heave of the vessel. Depending on their position relative to the center of the vessel, they may also act to reduce pitching motions of the vessel.

Figure 12:
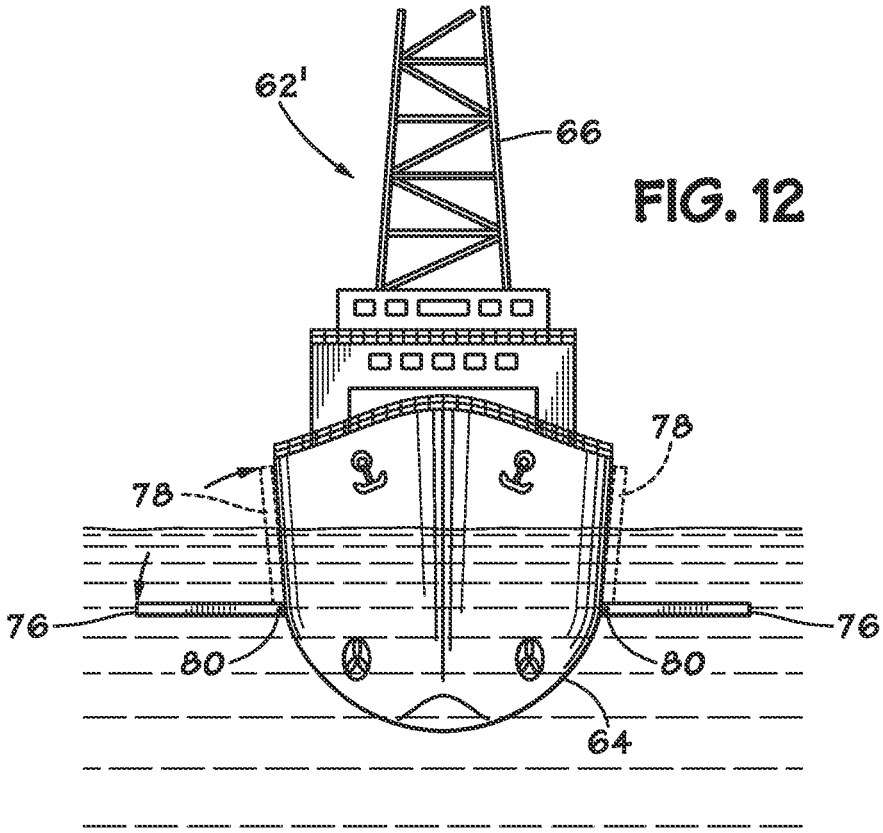
FIG. 12 is a front view of a drilling ship equipped with hinged roll stabilizers having damping apertures.
Figure 13:
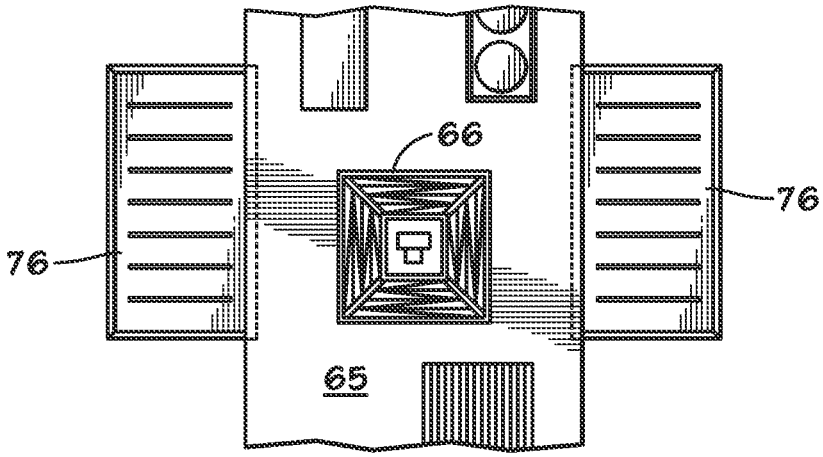
FIG. 13 is a top view of the drill ship shown in FIG. 12.

FIG. 13 is a top view of a portion of the drill ship 62' shown in FIG. 12. Motion dampers 76 may be moved into retracted position 78 (shown in phantom) by swinging on hinges 80. Braces (not shown) may be attached between hull 64 and motion dampers 76 to increase the structural rigidity of the extended dampers.

The motion dampers 76 shown in FIG. 13 are of the slotted plate type. It will be understood that plates having other aperture shapes (such as those illustrated in FIGS. 15 and 16) may also be used in the practice of the invention.

Figure 14:
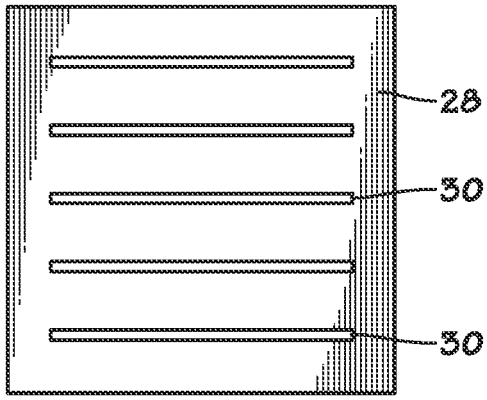
FIG. 14 is a plan view of a stabilizer plate having slot-type damping apertures.
Figure 15:
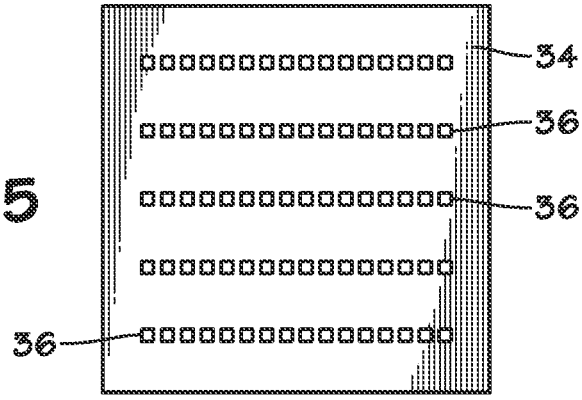
FIG. 15 is a plan view of a stabilizer plate having generally square damping apertures.
Figure 16:
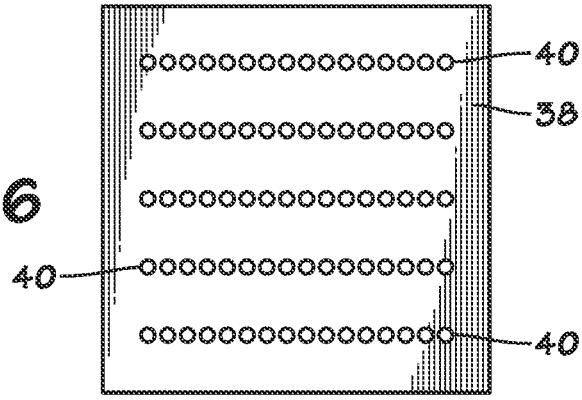
FIG. 16 is a plan view of a stabilizer plate having round hole-type damping apertures.

Damper plates according to the present invention preferably have between about 5% to about 15% porosity—i.e., the openings comprise about 5 to 15 percent of the total plate area (exclusive of support members). Particularly preferred is a damper plate having a porosity of about 10%. FIG. 14 is a plan view (to scale) of a slotted plate 28 having slots 30 which comprise 10% of the plate area. FIG. 15 is a plan view (also to scale) of a perforated plate 34 according to the invention which has substantially square apertures in a linear row-and-column configuration which comprise 10% of the plate area. FIG. 16 is a plan view (to scale) of a damper plate 40 according to the invention having holes (round apertures) 40 in a linear row-and-column configuration which comprise 10% of the plate area. It will be understood that other aperture configurations are also possible and may be employed without departing from the scope of the invention. Particularly preferred are aperture configurations which are "screen-like"—i.e., those that have relatively smaller apertures spaced relatively close together as opposed to configurations having fewer and larger spaced-apart openings (even though the total porosity may be equal).

Referring now to FIG. 17, semisubmersible 110 is a battered-column, semi-submersible drilling rig according to yet another embodiment of the invention. Deck 116 (upon which drilling equipment 118 may be mounted) is supported on battered columns 112 which project above the waterline. Buoyancy is provided by columns 112 and/or pontoons 114 which connect adjacent columns 112 and form the perimeter of damper array 125. Damper array 125 may have central opening 124 through which drill strings 122 or the like may pass. The invention may also be practiced with conventional semi-submersible rigs—i.e., those having vertical columns. When drilling operations are being conducted, rig 110 is held in position by catenary anchor lines 120 which connect to anchoring means on the seafloor. Alternatively, semi-submersible 110 may be a dynamically positioned vessel—i.e., equipped with computer-controlled thrusters for transit and station-keeping.

Damper array 125 comprises a plurality of damper modules 126 which extend between pontoons 114 and/or support beams 140 below the waterline of the vessel. Semi-submersible 110 shown in FIG. 17 has damper array 125 comprised of eight, separate damper modules 126 and a support grid comprised of four, intersecting support beams 140. Other embodiments may have additional damper plates and support beams. Yet other embodiments may have fewer damper plates and/or support beams. Those skilled in the art will appreciate that it may be desirable for hydrodynamic purposes to locate the damper plates symmetrically about the center of the vessel.

The embodiments illustrated in FIGS. 17-20 have damper plates which comprise slots 130. It will be appreciated that other perforation shapes (such as the rectangular or round holes described above in connection with the embodiments illustrated in FIGS. 1-16) may also be used. The damper modules (comprised of perforated plate 128 and perimeter support member 132) may also comprise multiple perforate plates such as is illustrated in FIGS. 5A and 5B and may have either offset (FIG. 5A) or aligned (FIG. 5B) perforations.

FIG. 19 shows one particular means for attaching a damper module 126 (comprised of plate 128+support 132) to structural support member 140 of the support grid. In the illustrated embodiment, support member 140 is a box beam [box girder] and has central cavity 142 which may, in certain embodiments, be a watertight cavity and thereby contribute to the buoyancy of the vessel. Extension 144 may also be a box beam and may be attached to or integral with one side of beam 140. Extension beam 144 may have a central, watertight cavity. Perimeter member 132 of a damper module may be affixed to extension 144 by any conventional means (e.g., welding and/or mechanical fasteners). Optionally, member 132 may additionally be secured to the adjacent surface of beam 140.

FIG. 20 shows an alternative embodiment of a semisubmersible 110' that is equipped with four damper modules 126 and has additional open areas 150 and 152 that are bounded by the support beams 140 in the space between its pontoons. Such additional open areas may be useful for the passage of risers, jumpers, umbilicals, drill strings and the like between deck 116 and equipment on the seafloor. Less than a full array of damper modules between the pontoons may, in certain situations, be sufficient for hydrodynamic purposes.

Although the invention has been described in detail with reference to certain preferred embodiments, variations and modifications exist within the scope and spirit of the invention as described and defined in the following claims.

What is claimed is:

1. A semisubmersible comprising:

a plurality of surface-piercing columns;

a plurality of subsurface pontoons attached to and extending between pairs of adjacent columns;

at least one support beam attached at a first end to a first pontoon and attached at a second end to an opposing, second pontoon;

at least one substantially horizontal, perforated plate having a porosity between about 5 percent and about 15 percent connected to the support beam.

2. A semisubmersible as recited in claim 1 further comprising at least one second support beam orthogonal to the first support beam and extending between and attached to, two, opposing pontoons and the perforated plate.

3. A semisubmersible as recited in claim 2 wherein the support beams have an internal cavity.

4. A semisubmersible as recited in claim 3 wherein the support beams have positive buoyancy.

5. A semisubmersible as recited in claim 1 wherein the porosity of the perforated plate is about 10 percent.

6. A semisubmersible as recited in claim 1 wherein the perforations in the perforated plate comprise slots.

7. A semisubmersible as recited in claim 1 wherein the perforations in the perforated plate comprise substantially round holes.

8. A semisubmersible as recited in claim 1 wherein the perforations in the perforated plate comprise substantially square apertures.

9. A semisubmersible as recited in claim 6 wherein each slot in the plate comprises less than about 2 percent of the total area of the plate.

10. A semisubmersible as recited in claim 7 wherein each hole in the plate comprises less than about 0.125 percent of the total area of the plate.

11. A semisubmersible as recited in claim 8 wherein each square aperture in the plate comprises less than about 0.125 percent of the total area of the plate.

12. A semisubmersible as recited in claim 1 wherein the columns are battered columns.

13. A semisubmersible comprising:

a plurality of surface-piercing columns;

a plurality of subsurface pontoons attached to and extending between pairs of adjacent columns;

a plurality of substantially parallel first support beams attached at a first end to a first pontoon and attached at a second end to an opposing, second pontoon;

a plurality of second support beams orthogonal to the first support beams and attached at a first end to a third pontoon and attached at a second end to a first support beam;

a plurality of substantially horizontal, perforated plates each having a porosity between about 5 percent and about 15 percent connected to at least one first support beam and at least one second support beam.

14. A semisubmersible as recited in claim 13 wherein at least one perforated plate is additionally connected to a pontoon.

15. A semisubmersible as recited in claim 13 wherein the first and second support beams define a plurality of openings at least one of which has no perforated plate therein.

16. A semisubmersible as recited in claim 13 further comprising a support member attached to the perimeter of the perforated plate and at least one support beam.

17. A semisubmersible as recited in claim 16 wherein the perimeter support member has an internal cavity.

18. A semisubmersible as recited in claim 17 wherein the support beams have positive buoyancy.

19. A semisubmersible as recited in claim 13 wherein the porosity of the perforated plate is about 10 percent.

20. A semisubmersible as recited in claim 13 wherein the perforations in the perforated plate comprise slots.

21. A semisubmersible as recited in claim 13 wherein the perforations in the perforated plate comprise substantially round holes.

22. A semisubmersible as recited in claim 13 wherein the perforations in the perforated plate comprise substantially square apertures.

23. A semisubmersible as recited in claim 20 wherein each slot in the plate comprises less than about 2 percent of the total area of the plate.

24. A semisubmersible as recited in claim 21 wherein each hole in the plate comprises less than about 0.125 percent of the total area of the plate.

25. A semisubmersible as recited in claim 22 wherein each square aperture in the plate comprises less than about 0.125 percent of the total area of the plate.

26. A semisubmersible as recited in claim 13 wherein the columns are battered columns.

27. A semisubmersible as recited in claim 13 wherein the support beams comprise box beams.

28. A semisubmersible as recited in claim 13 wherein the support beams have substantially horizontal, opposed top and bottom surfaces and substantially horizontal, opposed side surfaces and an extension attached to at least one side surface.

29. A semisubmersible as recited in claim 28 wherein the support beam extension is additionally attached to a perforated plate.

30. A semisubmersible as recited in claim 28 wherein the support beam extension is additionally attached to a perimeter support member on a perforated plate.

* * * * *